US005718779A

United States Patent [19]

Fukai et al.

[11] Patent Number: 5,718,779

[45] Date of Patent: Feb. 17, 1998

[54] METHOD FOR MANUFACTURING A + β TYPE TITANIUM ALLOY PLATE HAVING SMALL ANISOTROPY

[75] Inventors: Hideaki Fukai; Toru Izawa; Takayuki Kobayashi, all of Tokyo, Japan

[73] Assignee: NKK Corporation, Japan

[21] Appl. No.: 747,636

[22] Filed: Nov. 13, 1996

[30] Foreign Application Priority Data

Nov. 14, 1995 [JP] Japan ..... 7-295544

[51] Int. Cl.[6] ..... C22C 1/18

[52] U.S. Cl. ..... 148/670; 148/671

[58] Field of Search ..... 148/668, 669, 148/670, 671

[56] References Cited

U.S. PATENT DOCUMENTS

| | | | |
|---|---|---|---|
| 4,581,077 | 4/1986 | Sakuyama et al. | 148/670 |
| 4,830,683 | 5/1989 | Farguson | 148/670 |
| 4,871,400 | 10/1989 | Shindo et al. | 148/671 |

FOREIGN PATENT DOCUMENTS

| | | |
|---|---|---|
| 63-130753 | 6/1988 | Japan . |
| 2158373 | 11/1985 | United Kingdom . |

OTHER PUBLICATIONS

M.J. Donachie Jr.: "Titanium A Technical Guide" 1988, American Society for Metals, Metals Park, Ohio, pp. 47–50.

*Primary Examiner*—John Sheehan

*Attorney, Agent, or Firm*—Akin, Gump, Strauss, Hauer & Feld, L.L.P.

[57] ABSTRACT

A method for manufacturing an α+β type titanium alloy plate having a small anisotropy in strength by subjecting an α+β type titanium alloy slab to a hot-rolling, which comprises: the hot-rolling comprising a cross-rolling which comprises a hot-rolling in a L-direction and a hot-rolling in a C-direction, the L-direction being a final rolling direction in the hot-rolling and the C-direction being a direction at right angles to the L-direction; and controlling the cross-rolling so that a value of an overall cross ratio of rolling ($CR_{total}$) determined by means of the following formula is kept within a range of from 0.5 to 2.0:

$$CR_{total}=(CR_1)^{0.6}\times(CR_2)^{0.8}\times(CR_3)^{1.0}$$

where, $CR_1$ is a cross ratio of rolling within a rolling temperature region of from under Tβ °C. to Tβ °C.–50° C., $CR_2$ is a cross ratio of rolling within a rolling temperature region of from under Tβ °C.–50° C. to Tβ °C.–150° C., $CR_3$ is a cross ratio of rolling within a rolling temperature region of under Tβ °C.–150° C., and Tβ °C. is a β-transformation temperature of an α+β type titanium alloy.

7 Claims, 1 Drawing Sheet

METHOD FOR MANUFACTURING A + β TYPE TITANIUM ALLOY PLATE HAVING SMALL ANISOTROPY

REFERENCE TO PATENTS, APPLICATIONS AND PUBLICATIONS PERTINENT TO THE INVENTION

As far as we know, there is available the following prior art document pertinent to the present invention:

Japanese Patent Provisional Publication No. JP-A-63-130,753 published on Jun. 2, 1988.

The contents of the prior art disclosed in the above-mentioned prior art document will be discussed under the heading of "BACKGROUND OF THE INVENTION".

BACKGROUND OF THE INVENTION

1. Field of the Invention

The present invention relates to a method for manufacturing an α+β type titanium alloy plate, and more particularly, to a method for manufacturing an α+β type titanium alloy plate having a small anisotropy in strength.

2. Related Art Statement

It is the conventional practice to manufacture an α+β type titanium alloy plate having a prescribed thickness by slab-forging or slab-rolling an α+β type titanium alloy material such as an α+β type titanium alloy ingot into an α+β type titanium alloy slab, and then hot-rolling the thus prepared α+β type titanium alloy slab.

For hot-rolling an α+β type titanium alloy slab, there is a temperature region suitable for the hot-rolling from the point of view of hot-workability. Therefore, when hot-rolling an α+β type titanium alloy slab having a large cross-section into an α+β type titanium alloy plate, or when hot-rolling an α+β type titanium alloy slab into a thin α+β type titanium alloy plate (hereinafter referred to as the "thin-plate rolling"), it is difficult to manufacture a product having a desired thickness by a method for manufacturing an α+β type titanium alloy plate, which comprises once heating an α+β type titanium alloy slab, and then hot-rolling several times the thus once heated slab (hereinafter referred to as the "single-heat rolling"). In such a case, therefore, it is necessary to adopt a method for manufacturing an α+β type titanium alloy plate, which comprises reheating the single-heat rolled α+β type titanium alloy slab, and then hot-rolling several times the thus reheated slab (hereinafter referred to as the "multi-heat rolling").

When conducting the foregoing thin-plate rolling, furthermore, it is the common practice to apply a manner of rolling known as the pack-rolling which comprises covering at least an upper surface and a lower surface of an α+β type titanium alloy slab with a carbon steel sheet, and hot-rolling the α+β type titanium alloy slab thus covered with the carbon steel sheet.

When manufacturing a titanium plate, in general, a crystal texture is formed in a titanic slab during the hot-rolling thereof not only in the case of the α+β type titanium alloy, but also in the case of an α type titanium alloy or pure titanium. Consequently, anisotropy in strength is produced in the resultant product. For the purpose of restraining the production of anisotropy in strength, there is known a method comprising using a cross-rolling as the hot-rolling and controlling a cross ratio of rolling.

For example, Japanese Patent Provisional publication No. JP-A-63-130,753 published on Jun. 2, 1988 discloses a method for manufacturing a pure titanium plate having a small anisotropy, which comprises:

heating a pure titanium material having a thickness $t_0$ to a β-phase temperature region not exceeding 970° C., then slab-rolling the thus heated pure titanium material at a draft of at least 30% into a pure titanium slab having a thickness $t_1$, then cooling the resultant slab, then reheating the resultant cold slab to a temperature not exceeding a β-transformation temperature, then subjecting the thus reheated pure titanium slab to a hot-rolling comprising a cross-rolling in a rolling direction, in which a final rolling direction in the hot-rolling is at right angles to a rolling direction in the slab-rolling, while keeping a cross ratio of rolling $[(t_1/t_2)/(t_0/t_1)]$ within a range of from 0.5 to 3.0, to prepare a pure titanium plate having a thickness $t_2$, then cooling the resultant pure titanium plate, and then annealing the thus cooled pure titanium plate (hereinafter referred to as the "prior art 1").

In addition, there is available a common method for manufacturing an α+β type titanium alloy plate, which comprises cross-rolling an α+β type titanium alloy slab to minimize anisotropy in strength (hereinafter referred to as the "prior art 2").

The prior arts 1 and 2 described above, however, involve the following problems:

When hot-rolling an α+β type titanium alloy slab, and if a temperature region of the hot-rolling differs, an α-phase and a β-phase in the hot-rolled α+β type titanium alloy slab have different volume fractions. Even when the α+β type titanium alloys have the same chemical composition, therefore, the extent of the effect of a draft on anisotropy in strength varies depending upon temperature regions of the hot-rolling of the α+β type titanium alloy slabs. When hot-rolling an α+β type titanium alloy slab, therefore, it is impossible to satisfactorily restrain anisotropy in strength of an α+β type titanium alloy plate by means of a cross ratio of rolling determined simply only from a thickness of the α+β type titanium alloy slab before the hot-rolling and a thickness of the α+β type titanium alloy plate after the completion of the hot-rolling, as in the prior arts 1 and 2.

Under these circumstances, there is a strong demand for development of a method for manufacturing an α+β type titanium alloy plate having a small anisotropy in strength, but such a method has not as yet been proposed.

SUMMARY OF THE INVENTION

An object of the present invention is therefore to provide a method for manufacturing an α+β type titanium alloy plate excellent in isotropy with a small anisotropy in strength.

In accordance with one of the features of the present invention, there is provided a method for manufacturing an α+β type titanium alloy plate having a small anisotropy in strength by subjecting an α+β type titanium alloy slab to a hot-rolling, which comprises:

said hot-rolling comprising a cross-rolling which comprises a hot-rolling in an L-direction and a hot-rolling in a C-direction, said L-direction being a final rolling direction in said hot-rolling and said C-direction being a direction at right angles to said L-direction; and controlling said cross-rolling so that a value of an overall cross ratio of roling ($CR_{total}$) determined by means of the following formula is kept within a range of from 0.5 to 2.0:

$$CR_{total}=(CR_1)^{0.6}\times(CR_2)^{0.8}\times(CR_3)^{1.0}$$

where, $CR_{total}$: overall cross ratio of rolling, $CR_1$: cross ratio of rolling within a rolling temperature region of from under Tβ °C. to Tβ °C.–50° C., $CR_2$: cross ratio of rolling within a rolling temperature region of from under Tβ °C.–50° C. to Tβ °C.–150° C., $CR_3$: cross ratio of rolling within a rolling temperature region of under Tβ °C.–150° C., and Tβ °C.: β-transformation temperature of an α+β type titanium alloy.

$$CR_{total}=(CR_1)^{0.6}\times(CR_2)^{0.8}\times(CR_3)^{1.0}$$

Figure 1:
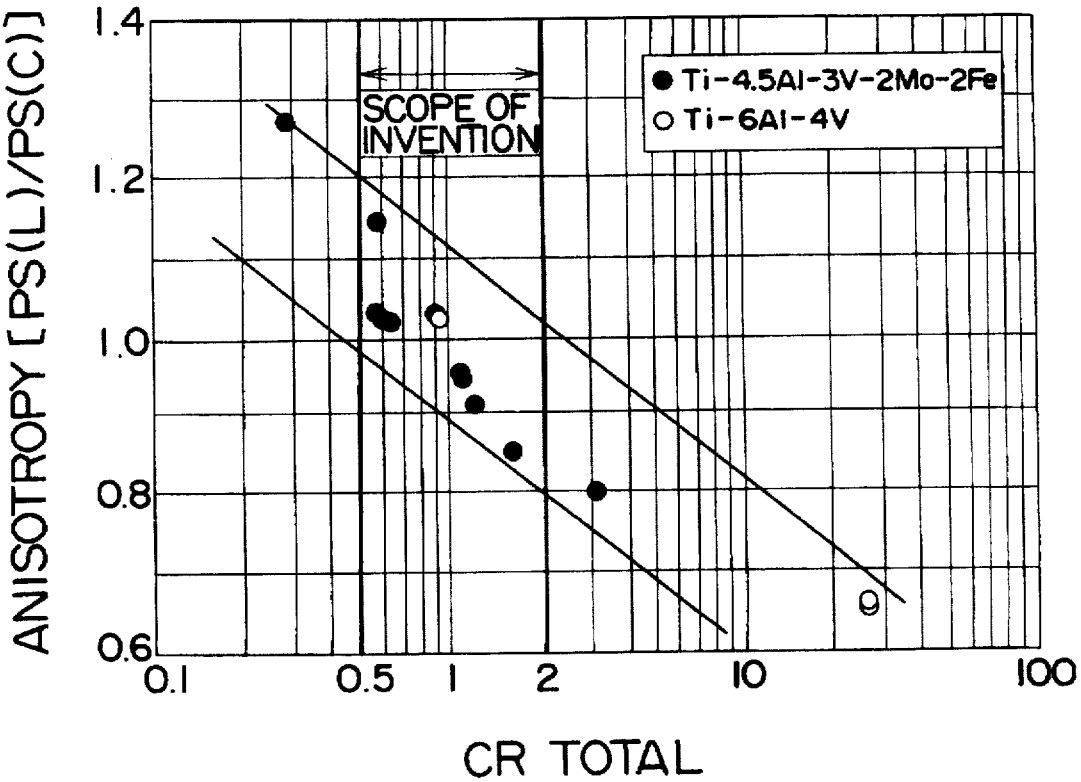
FIG. 1 is a graph illustrating the effect of an overall cross ratio of rolling ($CR_{total}$) determined by means of the following formula.

on anisotropy in strength of an α+β type titanium alloy plate.

DETAILED DESCRIPTION OF PREFERRED EMBODIMENTS

From the above-mentioned point of view, extensive studies were carried out to develop a method for manufacturing an α+β type titanium alloy plate excellent in isotropy with a small anisotropy in strength.

As a result, the following findings were obtained: Production of anisotropy in strength of an α+β type titanium alloy plate is attributable to the fact that, during the hot-rolling of an α+β type titanium alloy slab, an α-phase crystal texture is formed therein. In the hot-rolled α+β type titanium alloy slab, however, an α-phase and a β-phase have different volume fractions, depending upon a temperature region of the hot-rolling. Therefore, the extent of the effect of a cross ratio of rolling on anisotropy in strength depends upon a temperature region of the hot-rolling of the α+β type titanium alloy slab. Furthermore, anisotropy in strength of the α+β type titanium alloy slab produced during the preceding hot-rolling, still remains after reheating thereof. Therefore, a trial, as in the prior arts 1 and 2, to restrain anisotropy in strength of an α+β type titanium alloy plate by means of a cross ratio of rolling determined simply only from a thickness of the α+β type titanium alloy slab before the hot-rolling and a thickness of the α+β type titanium alloy plate after the completion of the hot-rolling, without taking account of a volume fraction of an α-phase in the α+β type titanium alloy slab, which varies depending upon a temperature region of the hot-rolling, does not give a satisfactory result.

Then, further studies were carried out, paying attention to the fact that the extent of the effect of a cross ratio of rolling on anisotropy in strength varies depending upon temperature regions of the hot-rolling of the α+β type titanium alloy slab. As a result, the following findings were obtained: It is possible to manufacture an α+β type titanium alloy plate having a small anisotropy in strength by dividing a temperature region of the hot-rolling into a plurality of appropriate rolling temperature regions, determining an overall cross ratio of rolling ($CR_{total}$) on the basis of a cross ratio of rolling determined for each of the thus divided individual rolling temperature regions, and cross-rolling an α+β type titanium alloy slab so as to keep a value of the overall cross ratio of rolling ($CR_{total}$) thus determined within a prescribed range.

The present invention was developed on the basis of the foregoing findings, and a method of the present invention for manufacturing an α+β type titanium alloy plate having a small anisotropy in strength by subjecting an α+β type titanium alloy slab to a hot-rolling, which comprises:

said hot-rolling comprising a cross-rolling which comprises a hot-rolling in an L-direction and a hot-rolling in a C-direction, said L-direction being a final rolling direction in said hot-rolling and said C-direction being a direction at right angles to said L-direction; and controlling said cross-rolling so that a value of an overall cross ratio of rolling ($CR_{total}$) determined by means of the following formula is kept within a range of from 0.5 to 2.0:

$$CR_{total}=(CR_1)^{0.6}\times(CR_2)^{0.8}\times(CR_3)^{1.0}$$

where, $CR_{total}$: overall cross ratio of rolling, $CR_1$: cross ratio of rolling within a rolling temperature region of from under Tβ °C. to Tβ °C.–50° C., $CR_2$: cross ratio of rolling within a rolling temperature region of from under Tβ °C.–50° C. to Tβ °C.–150° C., $CR_3$: cross ratio of rolling within a rolling temperature region of under Tβ °C.–150° C., and Tβ °C.: β-transformation temperature of an α+β type titanium alloy.

In the method of the present invention, the term of a cross ratio of rolling is defined as follows: When a final rolling direction in the hot-rolling of an a α+β type titanium alloy slab is referred to as an L-direction, and a direction at right angles to the L-direction is referred to as a C-direction, and when the thickness of the titanium alloy slab is reduced from $A_0$ to $A_1$ in the hot-rolling in the C-direction, and then, the thickness of the titanium alloy slab is reduced from $A_1$ to $A_2$ in the hot-rolling in the L-direction, the cross ratio of rolling is expressed by the following formula:

Cross ratio of rolling
= (draft of rolling in the L-direction)/(draft of rolling in the C-direction)
$= (A_1/A_2)/(A_0/A_1)$ (1)

The formula (1) can be rewritten as follows:

$$\text{Cross ratio of rolling}=(A_1/A_0)\times(A_1/A_2) \quad (2)$$

The formula (2) is used as the general formula of the cross ratio of rolling.

In the method of the present invention, an overall cross ratio of rolling ($CR_{total}$) is determined by the following formula (3):

$$CR_{total}=(CR_1)^{0.6}\times(CR_2)^{0.8}\times(CR_3)^{1.0} \quad (3)$$

where, $CR_{total}$: overall cross ratio of rolling, $CR_1$: cross ratio of rolling within a rolling temperature region of from under Tβ °C. to Tβ °C.–50° C., $CR_2$: cross ratio of rolling within a rolling temperature region of from under Tβ °C.–50° C. to Tβ °C.–150° C., $CR_3$: cross ratio of rolling within a rolling temperature region of under Tβ °C.–150° C., and Tβ °C.: β-transformation temperature of an α+β type titanium alloy, and $CR_1$, $CR_2$ and $CR_3$ are determined from the general formula (2) above.

Now, a first embodiment of the present invention is described below.

In the first embodiment of the present invention, a hot-rolling of an α+β type titanium alloy slab comprises a rough-rolling and a finish-rolling. Table 1 shows a pass schedule of the hot-rolling in the first embodiment of the present invention, i.e., a thickness reduction, a rolling temperature region, a rolling direction, a timing of turning of the rolling direction by 90° and a cross ratio of rolling in individual steps of the rough-rolling and the finish-rolling.

TABLE 1

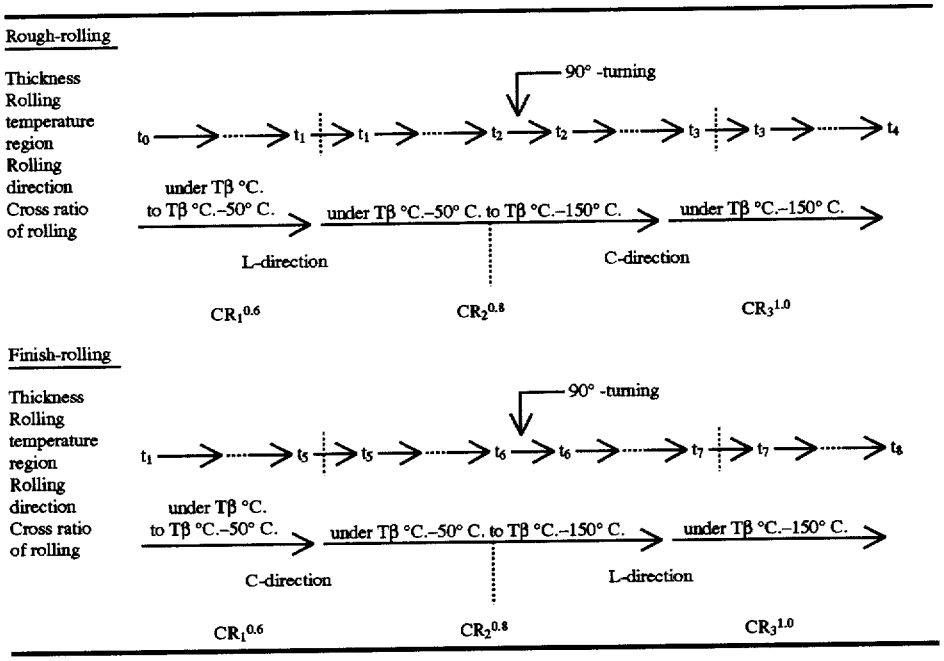

In the first embodiment of the present invention, as shown in Table 1, when a final rolling direction in a finish-rolling is referred to as an L-direction, and a direction at right angles to the L-direction is referred to as a C-direction, the first rolling direction in the finish-rolling is the same as the final rolling direction in the rough-rolling, i.e., the C-direction.

In the first embodiment of the present invention, an α+β type titanium alloy slab is soaked at a temperature of Tβ °C.−20° C. (Tβ °C. means a β-transformation temperature of an α+β type titanium alloy), and the thus soaked slab is subjected to a rough-rolling, and then to a finish-rolling, as described below.

Rough Rolling:

The slab soaked at a temperature of Tβ °C.−20° C. is reduced from thickness $t_0$ to $t_1$ within a rolling temperature region of from under Tβ °C. to Tβ °C.−50° C., and then the resultant slab is reduced from thickness $t_1$ to $t_2$ within a rolling temperature region of from under Tβ °C.−50° C. to Tβ °C.−150° C. Then the rolling direction of the slab is turned by 90° to resume the rough-rolling, then the slab is reduced from thickness $t_2$ to $t_3$ within a rolling temperature region of from under Tβ °C.−50° C. to Tβ °C.−150° C., and then the resultant slab is reduced from thickness $t_3$ to $t_4$ within a rolling temperature region of under Tβ °C.−150° C., thereby preparing a rough-rolled slab having a thickness $t_4$.

Finish-rolling:

The thus prepared rough-rolled slab having a thickness $t_4$ is reheated to a temperature of Tβ °C.−20° C., then the thus reheated rough-rolled slab is reduced from thickness $t_4$ to $t_5$ in the same rolling direction as the final rolling direction in the rough-rolling within a rolling temperature region of from under Tβ °C. to Tβ °C.−50° C., then the resultant slab is reduced from thickness $t_5$ to $t_6$ within a rolling temperature region of from under Tβ °C.−50° C. to Tβ °C.−150° C. Then the rolling direction of the slab is turned by 90° C. to resume the finish-rolling, then the slab is reduced from thickness $t_6$ to $t_7$ within a rolling temperature region of from under Tβ °C.−50° C. to Tβ °C.−150° C., and then the resultant slab is reduced from thickness $t_7$ to $t_8$ in the L-direction within a rolling temperature region of under Tβ °C.−150° C., thereby manufacturing an α+β type titanium alloy plate having a thickness $t_8$.

A cross ratio of rolling in the above-mentioned rough-rolling and finish-rolling is determined in accordance with the following formula:

Cross Ratio of Rolling in Rough-rolling:

$$(CR_1)^{0.6}=(t_0/t_1)^{0.6}$$

$$(CR_2)^{0.8}=(t_1/t_2)^{0.8}\times(t_3/t_2)^{0.8}, \text{ and}$$

$$(CR_3)^{1.0}=(t_4/t_3)^{1.0};$$

Cross Ratio in Finish-rolling:

$$(CR_1)^{0.6}=(t_5/t_4)^{0.6},$$

$$(CR_2)^{0.8}=(t_6/t_5)^{0.8}\times(t_6/t_7)^{0.8}, \text{ and}$$

$$(CR_3)^{1.0}=(t_7/t_8)^{1.0}.$$

Accordingly, an overall cross ratio of rolling ($CR_{total}$) in the first embodiment of the present invention is determinable by means of the following formula (4):

$$CR_{total} = (CR_1)^{0.6} \times (CR_2)^{0.8} \times (CR_3)^{1.0} \quad (4)$$
$$= [(CR_1)^{0.6} \times (CR_2)^{0.8} \times (CR_3)^{1.0} \text{ in rough-rolling}] \times [(CR_1)^{0.6} \times (CR_2)^{0.8} \times (CR_3)^{1.0} \text{ in finish-rolling}]$$
$$= [(t_0/t_1)^{0.6} \times \{(t_1/t_2)^{0.8} \times (t_3/t_2)^{0.8}\} \times (t_4/t_3)^{1.0}] \times [(t_5/t_4)^{0.6} \times \{(t_6/t_5)^{0.8} \times (t_6/t_7)^{0.8}\} \times (t_7/t_8)^{1.0}]$$

where, $CR_1$: cross ratio of rolling within a rolling temperature region of from under Tβ °C. to Tβ °C.−50° C., $CR_2$: cross ratio of rolling within a rolling temperature region of from under Tβ °C.−50° C. to Tβ °C.−150° C., $CR_3$: cross ratio of rolling within a rolling temperature region of under Tβ °C.−150° C., and Tβ °C.: β-transformation temperature of an α+β type titanium alloy.

In the first embodiment of the present invention, the hot-rolling comprising the rough-rolling and the finish-rolling of the α+β type titanium alloy slab, is controlled so as to keep a value of the overall cross ratio of rolling ($CR_{total}$) determined by means of the foregoing formula (4) within a range of from 0.5 to 2.0.

Now, a second embodiment of the present invention is described.

In the first embodiment of the present invention, as described above, the first rolling direction in the finish-rolling is the same as the final rolling direction in the rough-rolling. In the second embodiment of the present invention, in contrast, the first rolling direction in the finish-rolling is at right angles to the final rolling direction in the rough-rolling. The second embodiment of the present invention differs from the first embodiment of the present invention only in the foregoing point.

An overall cross ratio of rolling ($CR_{total}$) in the second embodiment of the present invention is determined by means of the following formula (5):

$$CR_{total} = [(t_1/t_0)^{0.6} \times \{(t_2/t_1)^{0.8} \times (t_2/t_3)^{0.8}\} \times (t_3/t_4)^{1.0}] \times [(t_5/t_4)^{0.6} \times \{(t_6/t_5)^{0.8} \times (t_6/t_7)^{0.8}\} \times (t_7/t_8)^{1.0}] \quad (5)$$

In the second embodiment of the present invention, the hot-rolling comprising the rough-rolling and the finish-rolling of the α+β type titanium alloy slab, is controlled so as to keep a value of the overall cross ratio of rolling ($CR_{total}$) determined by means of the foregoing formula (5) within a range of from 0.5 to 2.0.

In the method of the present invention, the temperature region of the hot-rolling of the α+β type titanium alloy slab is divided into the following three rolling temperature regions:

Rolling temperature region A: a rolling temperature region of from under Tβ °C. to Tβ °C.−50° C., Rolling temperature region B: a rolling temperature region of from under Tβ °C.−50° C. to Tβ °C.−150° C., and Rolling temperature region C: a rolling temperature region of under Tβ °C.−150° C.

and the cross ratio of rolling ($CR_1$, $CR_2$ and $CR_3$) is determined for each of these rolling temperature regions A, B and C, and the overall cross ratio of rolling ($CR_{total}$) is determined on the basis of $CR_1$, $CR_2$ and $CR_3$. The reasons therefor are as follows.

As previously described above, production of anisotropy in strength of an α+β type titanium alloy plate is attributable to the fact that, during the hot-rolling of an α+β type titanium alloy slab, an α-phase crystal texture is formed therein, and in the α+β type titanium alloy slab, an α-phase and a β-phase have different volume fractions, depending upon a temperature region of the hot-rolling.

More specifically, in a high-temperature region near the β-transformation temperature (Tβ °C.), the α-phase having an important effect on the formation of a crystal texture has only a small volume fraction. In contrast, the α-phase has a large volume fraction in a low-temperature region. In the hot-rolling at a low temperature, furthermore, the α-phase is more seriously deformed and more crystal textures of the α-phase are formed. As a result, in the hot-rolling in a relatively low-temperature region, more crystal textures of the α-phase which has an important effect on production of anisotropy are formed. When restraining production of anisotropy in strength by means of the cross-rolling, therefore, the effect of the cross ratio of rolling is smaller in the high-temperature region near Tβ °C., and larger in the low-temperature region. For this reason, it is necessary to place a weight on the cross ratio of rolling in response to the rolling temperature region.

In the method of the present invention, such weights as $(CR_1)^{0.6}$, $(CR_2)^{0.8}$ and $(CR_3)^{1.0}$ are placed on the cross ratios of rolling for the three rolling temperature regions A, B and C for the above-mentioned reason.

Therefore, the overall cross ratio of rolling ($CR_{total}$) determined by means of the following formula (3):

$$CR_{total}=(CR_1)^{0.6}\times(CR_2)^{0.8}\times(CR_3)^{1.0} \quad (3)$$

is most appropriately correlated with anisotropy in strength of the α+β type titanium plate.

Now, the reason of limiting a value of the above-mentioned overall cross ratio of rolling ($CR_{total}$) within a range of from 0.5 to 2.0 in the method of the present invention, is described below.

FIG. 1 is a graph illustrating the effect of an overall cross ratio of rolling ($CR_{total}$) determined by means of the following formula (3):

$$CR_{total}=(CR_1)^{0.6}\times(CR_2)^{0.8}\times(CR_3)^{1.0} \quad (3)$$

on anisotropy in strength of an α+β type titanium alloy plate.

The ordinate in FIG. 1 represents anisotropy in strength of the α+β type titanium alloy plate. This anisotropy in strength is expressed, when a final rolling direction of the hot-rolling of an α+β type titanium alloy slab is referred to as a L-direction, and a direction at right angles to the L-direction is referred to as a C-direction, by a ratio [PS(L)/PS(C)] of a 0.2% proof stress in the L-direction (hereinafter referred to as "PS(L)") to a 0.2% proof stress in the C-direction (hereinafter referred to as "PS(C)"), obtained by means of a tensile test.

In FIG. 1, the mark ● represents an α+β type titanium alloy slab comprising a Ti-4.5Al-3V-2Mo-2Fe alloy, and the mark ○ represents an α+β type titanium alloy slab comprising a Ti-6Al-4V alloy.

As is clear from FIG. 1, there is a close correlation between the overall cross ratio ($CR_{total}$) and anisotropy in strength [PS(L)/PS(C)].

When an absolute value of a difference between the 0.2% proof stress in the L-direction [PS(L)] and the 0.2% proof stress in the C-direction [PS(C)] of the α+β type titanium alloy plate is over 20% of the 0.2% proof stress in the L-direction [PS(L)] or the 20% proof stress in the C-direction [PS(C)], undesirable non-uniform deformations tend to be easily caused by anisotropy in strength upon working the α+β type titanium alloy plate. In order to minimize anisotropy in strength, therefore, it is necessary to limit a value of [PS(L)/PS(C)] within a range of from 0.80 to 1.20.

On the other hand, the overall cross ratio of rolling ($CR_{total}$) can be adjusted in a pass schedule of the hot-rolling. Anisotropy in strength can be restrained by adjusting the overall cross ratio of rolling ($CR_{total}$). As is clear from FIG. 1, therefore, in order to minimize anisotropy in strength of an α+β type titanium alloy plate, a value of the overall cross ratio of rolling ($CR_{total}$) should be limited within a range of from 0.5 to 2.0.

Now, the method of the present invention is described further in detail by means of examples while comparing with examples for comparison.

EXAMPLES

Example 1

An alloy comprising a Ti-4.5Al-3V-2Mo-2Fe alloy was employed as an α+β type titanium alloy. Since this titanium alloy has a β-transformation temperature (Tβ °C.) of 900° C., the temperature region of the hot-rolling of the titanium alloy slab was divided, in Example 1, into three rolling temperature regions of (1) from under 900° C. to 850° C., (2) from under 850° C. to 750° C., and (3) under 750° C.

First, an α+β type titanium alloy slab having a thickness of 200 mm and the above-mentioned chemical composition was soaked at a temperature of 880° C., and then rough-rolled in accordance with a pass schedule shown in Table 2. More particularly, the titanium alloy slab thus soaked was reduced from a thickness of 200 mm to 122 mm within a rolling temperature region of from under 880° C. to 850° C., and then was reduced from a thickness of 122 mm to 62 mm within a rolling temperature region of from under 850° C. to 750° C. Then the rolling direction of the slab was turned by 90° to resume the rough-rolling, then the slab was reduced from a thickness of 62 mm to 44 mm within a rolling temperature region of from under 850° C. to 750° C., and then the resultant slab was reduced from a thickness of from 44 mm to 20 mm within a rolling temperature region of under 750° C., thereby preparing a rough-rolled slab having a thickness of 20 mm.

The thus prepared rough-rolled slab having a thickness of 20 mm was reheated to a temperature of 880° C., and then finish-rolled in accordance with a pass schedule shown in Table 2. More specifically, the rough-rolled slab having a thickness of 20 mm was reduced from a thickness of 20 mm to 17 mm in the same rolling direction as the final rolling direction in the foregoing rough-rolling within a rolling temperature region of from under 880° C. to 850° C., and then was reduced from a thickness of 17 mm to 9 mm within a rolling temperature region of from under 850° C. to 750° C. Then the rolling direction of the slab was turned by 90° to resume the finish-rolling, then the slab was reduced from a thickness of 9 mm to 7 mm within a rolling temperature region of from under 850° C. to 750° C., and then the resultant slab was reduced from a thickness of 7 mm to 4 mm in the L-direction within a rolling temperature region of under 750° C., thereby obtaining an α+β type titanium alloy plate having a thickness of 4 mm. Subsequently, the resultant titanium alloy plate was cooled, and then annealed at a temperature of 720° C. for a period of time of an hour, thereby preparing an α+β type titanium alloy plate having a thickness of 4 mm within the scope of the present invention (hereinafter referred to as the "sample of the invention") No. 1.

In the above-mentioned rough-rolling and finish-rolling, a value of the overall cross ratio of rolling ($CR_{total}$) was kept within a range of from 0.5 to 2.0, which was within the scope of the present invention.

Then, while keeping a value of the overall cross ratio of rolling ($CR_{total}$) within a range of from 0.5 to 2.0, which was within the scope of the present invention, α+β type titanium alloy slabs having the same chemical composition and the same thickness as those in the sample of the invention No. 1, were rough-rolled and then finish-rolled in accordance with pass schedules shown in Tables 2 to 4, and 6 in the same manner as described above, thereby obtaining α+β type titanium alloy plates having a thickness of 4 mm. Then the resultant titanium alloy plates were cooled, and then annealed at a temperature of 720° C. for a period of time of an hour, thereby preparing α+β type titanium alloy plates having a thickness of 4 mm within the scope of the present invention (hereinafter referred to as the "samples of the invention") Nos. 2 to 6, 9 and 10.

Then, while keeping a value of the overall cross ratio of rolling ($CR_{total}$) within a range of from 0.5 to 2.0, which was within the scope of the present invention, α+β type titanium alloy slabs having the same chemical composition and the same thickness as those of the sample of the invention No. 1, were subjected to the single-heat rolling in accordance with pass schedules shown in Table 7, thereby obtaining α+β type titanium alloy plates having a thickness of 20 mm. Then the resultant titanium alloy plates were cooled, and then annealed at a temperature of 720° C. for a period of time of an hour, thereby preparing α+β type titanium alloy plates having a thickness of 20 mm within the scope of the present invention (hereinafter referred to as the "samples of the invention") Nos. 11 and 12.

Subsequently, for comparison purposes, α+β type titanium alloy slabs having the same chemical composition and the same thickness as those of the sample of the invention No. 1, were rough-rolled and then finish-rolled in accordance with pass schedules shown in Tables 5 and 7 in the same manner as described in the sample of the invention No.1, while keeping a value of the overall cross ratio of rolling ($CR_{total}$) under 0.5 or over 2.0, which was outside the scope of the present invention, thereby obtaining α+β type titanium alloy plates having a thickness of 4 mm. Then, the resultant titanium alloy plates were cooled, and then annealed at a temperature of 720° C. for a period of time of an hour, thereby preparing α+β type titanium alloy plates having a thickness of 4 mm outside the scope of the present invention (hereinafter referred to as the "samples for comparison") Nos. 7, 8 and 13.

TABLE 2

| No. | | Pass schedule | Remark |
|---|---|---|---|
| 1 | (Thickness) Rough-rolling | 200 → 170 → 144 → 122 → 103 → 87 → 73 → 62 → 52 → 44 → 37 → 31 → 26 → 22 → 20<br>↑ (90° -turning)<br>← under 900 to 850° C. → ← under 850 to 750° C. → ← under 750° C. → | Sample of the invention |
| | (Thickness) Finish-rolling | 20 → 17 → 14 → 11 → 9 → 7 → 5.5 → 4<br>↑ (90° C. -turning)<br>← under 900 to 850° C → ← under 850 to 750° C. → ← under 750° C. → | |
| 2 | (Thickness) Rough-rolling | 200 → 170 → 144 → 122 → 103 → 87 → 73 → 62 → 52 → 44 → 37 → 31 → 26 → 22 → 20<br>↑ (90° -turning)<br>← under 900 to 850° C. → ← under 850 to 750° C. → ← under 750° C. → | Sample of the invention |
| | (Thickness) Finish-rolling | 20 → 17 → 14 → 11 → 9 → 7 → 5.5 → 4<br>↑ (90° C. -turning)<br>← under 900 to 850° C → ← under 850 to 750° C. → ← under 750° C. → | |

TABLE 3

| No. | | Pass schedule | Remark |
|---|---|---|---|
| 3 | (Thickness) Rough-rolling | 200 → 170 → 144 → 122 → 103 → 87 → 73 → 62 → 52 → 44 → 37 → 31 → 26 → 22 → 20<br>↑ (90° -turning)<br>← under 900 to 850° C. → ← under 850 to 750° C. → ← under 750° C. → | Sample of the invention |
| | (Thickness) Finish-rolling | 20 → 17 → 14 → 11 → 9 → 7 → 5.5 → 4<br>↑ (90° C. -turning)<br>← under 900 to 850° C → ← under 850 to 750° C. → ← under 750° C. → | |
| 4 | (Thickness) Rough-rolling | 200 → 170 → 144 → 122 → 103 → 87 → 73 → 62 → 52 → 44 → 37 → 31 → 26 → 22 → 20<br>← under 900 to 850° C. → ← under 850 to 750° C. → ← under 750° C. → | Sample of the invention |
| | (Thickness) Finish-rolling | 20 → 17 → 14 → 11 → 9 → 7 → 5.5 → 4<br>← under 900 to 850° C → ← under 850 to 750° C. → ← under 750° C. → | |

TABLE 4

| No. | | Pass schedule | Remark |
|---|---|---|---|
| 5 | (Thickness) Rough-rolling | 200 → 170 → 144 → 122 → 103 → 87 → 73 → 62 → 52 → 44 → 37 → 31 → 26 → 22 → 20<br>↑ (90° -turning)<br>under 900 to 850° C. / under 850 to 750° C. / under 750° C. | Sample of the invention |
| | (Thickness) Finish-rolling | 20 → 17 → 14 → 11 → 9 → 7 → 5.5 → 4<br>↑ (90° C. -turning)<br>under 900 to 850° C / under 850 to 750° C. / under 750° C. | |
| 6 | (Thickness) Rough-rolling | 200 → 170 → 144 → 122 → 103 → 87 → 73 → 62 → 52 → 44 → 37 → 31 → 26 → 22 → 20<br>↑ (90° -turning)<br>under 900 to 850° C. / under 850 to 750° C. / under 750° C. | Sample of the invention |
| | (Thickness) Finish-rolling | 20 → 17 → 14 → 11 → 9 → 7 → 5.5 → 4<br>↑ (90° C. -turning)<br>under 900 to 850° C / under 850 to 750° C. / under 750° C. | |

TABLE 5

| No. | | Pass schedule | Remark |
|---|---|---|---|
| 7 | (Thickness) Rough-rolling | 200 → 170 → 144 → 122 → 103 → 87 → 73 → 62 → 52 → 44 → 37 → 31 → 26 → 22 → 20<br>under 900 to 850° C. / under 850 to 750° C. / under 750° C. | Sample for comparison |
| | (Thickness) Finish-rolling | 20 → 17 → 14 → 11 → 9 → 7 → 5.5 → 4<br>under 900 to 850° C / under 850 to 750° C. / under 750° C. | |
| 8 | (Thickness) Rough-rolling | 200 → 170 → 144 → 122 → 103 → 87 → 73 → 62 → 52 → 44 → 37 → 31 → 26 → 22 → 20<br>↑ (90° -turning)<br>under 900 to 850° C. / under 850 to 750° C. / under 750° C. | Sample for comparison |
| | (Thickness) Finish-rolling | 20 → 17 → 14 → 11 → 9 → 7 → 5.5 → 4<br>↑ (90° C. -turning)<br>under 900 to 850° C / under 850 to 750° C. / under 750° C. | |

TABLE 6

| No. | | Pass schedule | Remark |
|---|---|---|---|
| 9 | (Thickness) Rough-rolling | 200 → 170 → 144 → 122 → 103 → 87 → 73 → 62 → 52 → 44 → 37 → 31 → 26 → 22 → 20<br>↑ (90° -turning) | Sample of the invention |
| | | ⟷ under 900 to 850° C. ⟷ under 850 to 750° C. ⟷ under 750° C. ⟷ | |
| | (Thickness) Finish-rolling | 20 → 17 → 14 → 11 → 9 → 7 → 5.5 → 4<br>↑ (90° C. -turning) | |
| | | ⟷ under 900 to 850° C ⟷ under 850 to 750° C. ⟷ under 750° C. ⟷ | |
| 10 | (Thickness) Rough-rolling | 200 → 170 → 144 → 122 → 103 → 87 → 73 → 62 → 52 → 44 → 37 → 31 → 26 → 22 → 20<br>↑ (90° -turning) | Sample of the invention |
| | | ⟷ under 900 to 850° C. ⟷ under 850 to 750° C. ⟷ under 750° C. ⟷ | |
| | (Thickness) Finish-rolling | 20 → 17 → 14 → 11 → 9 → 7 → 5.5 → 4<br>↑ (90° C. -turning) | |
| | | ⟷ under 900 to 850° C ⟷ under 850 to 750° C. ⟷ under 750° C. ⟷ | |

TABLE 7

| No. | | Pass schedule | Remark |
|---|---|---|---|
| 11 | (Thickness) Finish-rolling | 200 → 170 → 144 → 122 → 103 → 87 → 73 → 62 → 52 → 44 → 37 → 31 → 26 → 22 → 20<br>↑ (90° -turning) | Sample of the invention |
| | | ⟷ under 900 to 850° C. ⟷ under 850 to 750° C. ⟷ under 750° C. ⟷ | |
| 12 | (Thickness) Finish-rolling | 200 → 170 → 144 → 122 → 103 → 87 → 73 → 62 → 52 → 44 → 37 → 31 → 26 → 22 → 20<br>↑ (90° -turning) | Sample of the invention |
| | | ⟷ under 900 to 850° C. ⟷ under 850 to 750° C. ⟷ under 750° C. ⟷ | |
| 13 | (Thickness) Rough-rolling | 200 → 170 → 144 → 122 → 103 → 87 → 73 → 62 → 52 → 44 → 37 → 31 → 26 → 22 → 20 | Sample for comparison |
| | | ⟷ under 900 to 850° C. ⟷ under 850 to 750° C. ⟷ under 750° C. ⟷ | |
| | (Thickness) Finish-rolling | 20 → 17 → 14 → 11 → 9 → 7 → 5.5 → 4 | |
| | | ⟷ under 900 to 850° C ⟷ under 850 to 750° C. ⟷ under 750° C. ⟷ | |

In the samples of the invention Nos. 1 to 3, 5, 6, 9 and 10, and the samples for comparison Nos. 8 and 13, the final rolling direction in the rough-rolling was the same as the first rolling direction in the finish-rolling.

In the sample of the invention No. 4, the turning by right angles of the rolling direction was not effected during the rough-rolling and during the finish-rolling, and the rolling direction in the finish-rolling was at right angles to the rolling direction in the rough-rolling.

In the sample for comparison No. 7, the turning by right angles of the rolling direction was not effected during the rough-rolling and during the finish-rolling, and the rolling direction in the finish-rolling was the same as the rolling direction in the rough-rolling.

In the samples of the invention Nos. 11 and 12, the single-heat rolling was carried out, and the turning by right angles of the rolling direction was effected once in the middle of the rolling.

A value of the overall cross ratio of rolling ($CR_{total}$) as expressed by the formula (3) described above was determined for each of the samples of the invention and the samples for comparison. A 0.2% proof stress in the L-direction [PS(L)] and a 0.2% proof stress in the C-direction [PS(C)] were measured by means of a tensile test for each of the samples of the invention and the samples for comparison to determine a value of the ratio [PS(L)/PS(C)] of PS(L) to PS(C). The values thus determined are shown in Table 8.

TABLE 8

| No. | $CR_{total}$ according to formula(3) | 0.2% proof stress in L-direction [PS(L)] | 0.2% proof stress in C-direction [PS(C)] | PS(L) PS(C) | Remark |
|---|---|---|---|---|---|
| 1 | 0.932 | 899 MPa | 870 MPa | 1.022 | Sample of the invention |
| 2 | 1.614 | 881 MPa | 1032 MPa | 0.854 | |
| 3 | 0.625 | 897 MPa | 879 MPa | 1.020 | |
| 4 | 0.564 | 907 MPa | 880 MPa | 1.031 | |
| 5 | 0.587 | 907 MPa | 884 MPa | 1.026 | |
| 6 | 1.099 | 859 MPa | 903 MPa | 0.951 | |
| 7 | 26.234 | 674 MPa | 1028 MPa | 0.656 | Sample for comparison |
| 8 | 3.090 | 786 MPa | 981 MPa | 0.801 | |
| 9 | 0.571 | 1007 MPa | 881 MPa | 1.143 | Sample of the invention |
| 10 | 1.080 | 887 MPa | 916 MPa | 0.957 | |
| 11 | 1.204 | 880 MPa | 965 MPa | 0.911 | |
| 12 | 0.909 | 910 MPa | 881 MPa | 1.033 | |
| 13 | 0.284 | 1044 MPa | 822 MPa | 1.270 | Sample for comparison |

As is clear from Table 8, in any of the samples of the invention Nos. 1 to 6 and 9 to 12, in which the value of the overall cross ratio of rolling ($CR_{total}$) determined by means of the formula (3) was within a range of from 0.5 to 2.0, which was within the scope of the present invention, the value of the ratio [PS(L)/PS(C)] of the 0.2% proof stress in the L-direction [PS(L)] to the 0.2% proof stress in the C-direction [PS(C)], was within a range of from 0.80 to 1.20. Therefore, any of the α+β type titanium alloy plates manufactured according to the method of the present invention was excellent in isotropy with a small anisotropy in strength.

In contrast, in any of the samples for comparison Nos. 7, 8 and 13, in which the value of the overall cross ratio of rolling ($CR_{total}$) determined by means of the formula (3) was under 0.5 or over 2.0, which was outside the scope of the present invention, the value of the ratio [PS(L)/PS(C)] of the 0.2% proof stress in the L-direction [PS(L)] to the 0.2% proof stress in the C-direction [PS(C)], was under 0.80 or over 1.20. Therefore, any of the α+β type titanium alloy plates manufactured according to the method outside the scope of the present invention had a large anisotropy in strength.

Example 2

An alloy comprising a Ti-6Al-4V alloy was employed as an α+β type titanium alloy. Since this titanium alloy has a β-transformation temperature (Tβ °C.) of 1,000° C., the temperature region of the hot-rolling of the titanium alloy slab was divided, in Example 2, into three rolling temperature regions of (1) from under 1,000° C. to 950° C., (2) from under 950° C. to 850° C., and (3) under 850° C.

While keeping a value of the overall cross ratio of rolling ($CR_{total}$) within a range of from 0.5 to 2.0, an α+β type titanium alloy slab having a thickness of 200 mm and the above-mentioned chemical composition, was rough-rolled and then finish-rolled in accordance with a pass schedule shown in Table 9 in the same manner as in the sample of the invention No. 1, thereby obtaining an α+β type titanium alloy plate having a thickness of 4 mm. Then, the resultant titanium alloy plate was cooled, and then annealed at a temperature of 720° C. for a period of time of an hour, thereby preparing an α+β type titanium alloy plate having a thickness of 4 mm within the scope of the present invention (hereinafter referred to as the "sample of the invention") No. 14.

Then, for comparison purposes, an α+β type titanium alloy slab having the same chemical composition and the same thickness as those in the sample of the invention No. 14, was rough-rolled and then finish-rolled in accordance with a pass schedule shown in Table 9 in the same manner as described above, while keeping a value of the overall cross ratio of rolling ($CR_{total}$) under 0.5 or over 2.0, which was outside the scope of the present invention, thereby obtaining an α+β type titanium alloy plate having a thickness of 4 mm. Then the resultant titanium alloy plate was cooled, and then annealed at a temperature of 720° C. for a period of time of an hour, thereby preparing an α+β type titanium alloy plate having a thickness of 4 mm outside the scope of the present invention (hereinafter referred to as the "sample for comparison") No. 15.

TABLE 9

| No. | | Pass schedule | Remark |
|---|---|---|---|
| 14 | (Thickness) Rough-rolling | 200 → 170 → 144 → 122 → 103 → 87 → 73 → 62 → 52 → 44 → 37 → 31 → 26 → 22 → 20<br>↑ (90° -turning)<br>under 1000 to 950° C. ⟷ under 950 to 850° C. ⟷ under 850° C. | Sample of the invention |
| | (Thickness) Finish-rolling | 20 → 17 → 14 → 11 → 9 → 7 → 5.5 → 4<br>↑ (90° C. -turning)<br>under 1000 to 950° C ⟷ under 950 to 850° C. ⟷ under 850° C. | |
| 15 | (Thickness) Rough-rolling | 200 → 170 → 144 → 122 → 103 → 87 → 73 → 62 → 52 → 44 → 37 → 31 → 26 → 22 → 20<br>under 900 to 850° C. ⟷ under 850 to 750° C. ⟷ under 750° C. | Sample for comparison |
| | (Thickness) Finish-rolling | 20 → 17 → 14 → 11 → 9 → 7 → 5.5 → 4<br>under 1000 to 950° C ⟷ under 950 to 850° C. ⟷ under 850° C. | |

In the sample of the invention No. 14, the final rolling direction in the rough-rolling was the same as the first rolling direction in the finish-rolling.

In the sample for comparison No. 15, the turning by right angles of the rolling direction was not effected during the rough-rolling and during the finish-rolling, and the rolling direction in the finish-rolling was the same as the rolling direction in the rough-rolling.

A value of the overall cross ratio of rolling ($CR_{total}$) as expressed by the formula (3) described above was determined for each of the samples of the invention and the samples for comparison. A 0.2% proof stress in the L-direction [PS(L)] and a 0.2% proof stress in the C-direction [PS(C)] were measured by means of a tensile test for each of the samples of the invention and the sampels for comparison to determine a value of the ratio [PS(L)/PS(C)] of PS(L) to PS(C). The values thus determined are shown in Table 10.

TABLE 10

| No. | $CR_{total}$ according to formula(3) | 0.2% proof stress in L-direction [PS(L)] | 0.2% proof stress in C-direction [PS(C)] | PS(L) PS(C) | Remark |
|---|---|---|---|---|---|
| 14 | 0.932 | 1004 MPa | 981 MPa | 1.023 | Sample of the invention |
| 15 | 26.234 | 743 MPa | 1133 MPa | 0.656 | Sample for comparison |

As is clear from Table 10, in the sample of the invention No. 14, in which the value of the overall cross ratio of rolling ($CR_{total}$) determined by means of the formula (3) was within a range of from 0.5 to 2.0, which was within the scope of the present invention, the value of the ratio [PS(L)/PS(C)] of the 0.2% proof stress in the L-direction [Ps(L)] to the 0.2% proof stress in the C-direction [PS(C)], was within a range of from 0.80 to 1.20. Therefore, the α+β type titanium alloy plate manufactured according to the method of the present invention, was excellent in isotropy with a small anisotropy in strength.

In contrast, in the sample for comparison No. 15, in which the value of the overall cross ratio of rolling ($CR_{total}$) determined by means of the formula (3) was over 2.0, which was outside the scope of the present invention, the value of the ratio [PS(L)/PS(C)] of the 0.2% proof stress in the L-direction [PS(L)] to the 0.2% proof stress in the C-direction [PS(C)], was under 0.80. Therefore, the α+β type titanium alloy plate manufactured according to the method outside the scope of the present invention had a large anisotropy in strength.

According to the method of the present invention, as described above in detail, it is possible to efficiently manufacture an α+β type titanium alloy plate excellent in isotropy with a small anisotropy in strength, thus providing many industrially useful effects.

What is claimed is:

1. A method for manufacturing an α+β titanium alloy plate having a small anisotropy in strength by subjecting an α+β titanium alloy slab to a hot-rolling, which comprises:

said hot-rolling comprising a cross-rolling which comprises a hot-rolling in an L-direction and a hot-rolling in a C-direction, said L-direction being a final rolling direction in said hot-rolling and said C-direction being a direction at right angles to said L-direction; and controlling said cross-rolling so that a value of an overall cross ratio of rolling ($CR_{total}$) determined by means of the following formula is kept within a range of from 0.5 to 2.0:

$$CR_{total}=(CR_1)^{0.6}\times(CR_2)^{0.8}\times(CR_3)^{1.0}$$

where, $CR_{total}$: overall cross ratio of rolling, $CR_1$: cross ratio of rolling within a rolling temperature region of from under Tβ °C. to Tβ °C.−50° C., $CR_2$: cross ratio of rolling within a rolling temperature region of from under Tβ °C.−50° C. to Tβ °C.−150° C., $CR_3$: cross ratio of rolling within a rolling temperature region of under Tβ °C.−150° C., and Tβ °C.: β-transformation temperature of an α+β titanium alloy.

2. A method as claimed in claim 1, wherein:

said cross-rolling comprises a cross-rolling in a rough-rolling and a cross-rolling in a finish-rolling; and controlling said cross-rolling so that a value of an overall cross ratio of rolling ($CR_{total}$) determined by means of the following formula is kept within a range of from 0.5 to 2.0:

$$CR_{total} = [(CR_1)^{0.6} \times (CR_2)^{0.8} \times (CR_3)^{1.0} \text{ in rough-rolling}] \times [(CR_1)^{0.6} \times (CR_2)^{0.8} \times (CR_3)^{1.0} \text{ in finish-rolling}].$$

3. A method as claimed in claim 1 or 2, wherein:

a value of a ratio [PS(L)/PS(C)] of a 0.2% proof stress in said L-direction [PS(L)] to a 0.2% proof stress in said C-direction [PS(C)] is within a range of from 0.80 to 1.20.

4. A method as claimed in claim 1 or 2, wherein:

said α+β titanium alloy slab comprises a Ti-4.5Al-3V-2Mo-2Fe alloy.

5. A method as claimed in claim 1 or 2, wherein:

said α+β titanium alloy slab comprises a Ti-6Al-4V alloy.

6. A method as claimed in claim 3, wherein:

said α+β titanium alloy slab comprises a Ti-4.5Al-3V-2Mo-2Fe alloy.

7. A method as claimed in claim 3, wherein:

said α+β titanium alloy slab comprises a Ti-6Al-4V alloy.

* * * * *